US010854176B1

(12) United States Patent
Lupton

(10) Patent No.: US 10,854,176 B1
(45) Date of Patent: Dec. 1, 2020

(54) HIGH HAT STAND ASSEMBLY

(71) Applicant: Joshua Lupton, Norman, OK (US)

(72) Inventor: Joshua Lupton, Norman, OK (US)

( * ) Notice: Subject to any disclaimer, the term of this patent is extended or adjusted under 35 U.S.C. 154(b) by 0 days.

(21) Appl. No.: 16/728,076

(22) Filed: Dec. 27, 2019

(51) Int. Cl.
*G10D 13/065* (2020.01)

(52) U.S. Cl.
CPC ..... *G10D 13/065* (2013.01)

(58) Field of Classification Search
CPC ..... G10D 13/065
See application file for complete search history.

(56) References Cited

U.S. PATENT DOCUMENTS 4,111,095 A * 9/1978 Simons ..... G10D 13/065 248/125.1
4,177,709 A * 12/1979 Adams ..... G10D 13/065 84/402
4,497,238 A 2/1985 Dasovich
4,517,876 A * 5/1985 Duhon ..... G10D 13/065 84/421
4,846,040 A * 7/1989 Hoshino ..... G10D 13/065 84/422.1
5,028,776 A 7/1991 Forti
5,388,495 A * 2/1995 Atsumi ..... G10D 13/065 84/422.3
5,945,616 A * 8/1999 Hoshino ..... G10D 13/065 84/422.3
6,229,080 B1 * 5/2001 Ishimatsu ..... G10D 13/065 84/422.1
6,316,708 B1 * 11/2001 Kuppers ..... G10D 13/065 84/422.1
6,320,109 B1 * 11/2001 Kuppers ..... G10D 13/065 84/422.1
6,326,534 B1 * 12/2001 Ishimatsu ..... G10D 13/065 84/422.1
6,399,865 B1 * 6/2002 Ishimatsu ..... G10D 13/065 84/421
6,437,225 B1 * 8/2002 Shigenaga ..... G10D 13/065 84/422.1
6,967,273 B2 * 11/2005 Hsieh ..... G10D 13/065 84/422.1
6,977,333 B2 * 12/2005 Sutej ..... G10D 13/065 84/422.1
7,371,952 B1 * 5/2008 Tanaka ..... G10D 13/065 84/422.1
7,696,423 B1 * 4/2010 Schiano ..... G10D 13/065 84/422.3
8,153,877 B2 4/2012 Coady
8,198,522 B2 * 6/2012 Michael ..... G10D 13/065 84/422.3

(Continued)

*Primary Examiner* — Robert W Horn

(57) ABSTRACT

A high hat stand assembly includes a lower cylinder that is positioned on a high hat pedal of a drum kit. A middle cylinder extends upwardly from the lower cylinder and a top cylinder is slidably positioned on the middle cylinder. The top cylinder is biased upwardly on the middle cylinder. A high hat rod is coupled to and extends upwardly from the middle cylinder. A bottom cymbal of a high hat is fixed to the top cylinder and a top cymbal of the high hat is fixed to the high hat rod. A lowering unit is movably integrated between the lower cylinder, the middle cylinder and the top cylinder. The lowering unit urges the top cylinder downwardly on the middle cylinder when the lowering unit is actuated such that the bottom cymbal is spaced from the top cymbal.

12 Claims, 5 Drawing Sheets

(56) References Cited

U.S. PATENT DOCUMENTS

| | | | | |
|---|---|---|---|---|
| 8,946,531 | B2 * | 2/2015 | Nakata | F16F 1/121<br>84/422.3 |
| 9,053,693 | B1 * | 6/2015 | Wei | G10D 13/065 |
| 9,093,052 | B2 * | 7/2015 | Turpen | G10D 13/065 |

* cited by examiner

HIGH HAT STAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to high hat devices and more particularly pertains to a new high hat device for retaining a high hat in normally closed position.

(2) Description of Related Art Including Information Disclosed Under 37 CFR 1.97 and 1.98

The prior art relates to high hat devices. The prior art discloses a high hat stand that is adjustable between a normally closed condition or a normally open condition. The prior art discloses a high hat stand that has an electronic sensor for sensing when a user's foot is on a pedal of the high hat stand for adjusting between an open condition or a closed condition. The prior art discloses a high that stand, comprising a series of slidable tubes, which additionally includes a full length high hat rod extending fully through the slidable tubes. The prior art further discloses a high hat stand that includes a magnetic clutch for controlling the position of a top cymbal of a high hat.

BRIEF SUMMARY OF THE INVENTION

An embodiment of the disclosure meets the needs presented above by generally comprising a lower cylinder that is positioned on a high hat pedal of a drum kit. A middle cylinder extends upwardly from the lower cylinder and a top cylinder is slidably positioned on the middle cylinder. The top cylinder is biased upwardly on the middle cylinder. A high hat rod is coupled to and extends upwardly from the middle cylinder. A bottom cymbal of a high hat is fixed to the top cylinder and a top cymbal of the high hat is fixed to the high hat rod. A lowering unit is movably integrated between the lower cylinder, the middle cylinder and the top cylinder. The lowering unit urges the top cylinder downwardly on the middle cylinder when the lowering unit is actuated such that the bottom cymbal is spaced from the top cymbal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
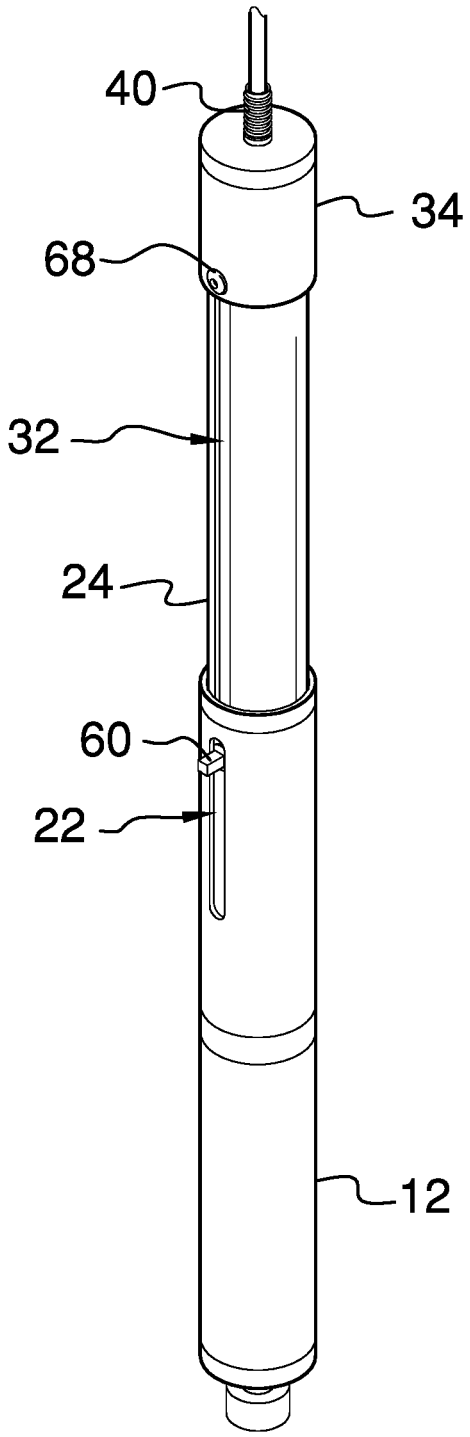
FIG. 1 is a perspective view of a high hat stand assembly according to an embodiment of the disclosure.
Figure 2:
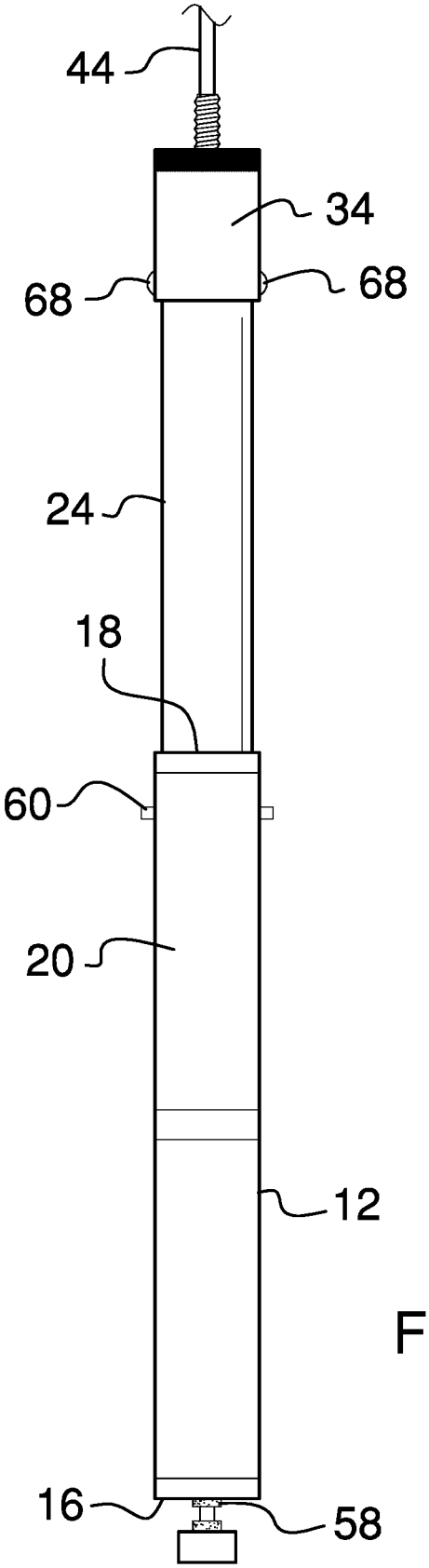
FIG. 2 is a front view of an embodiment of the disclosure.
Figure 3:
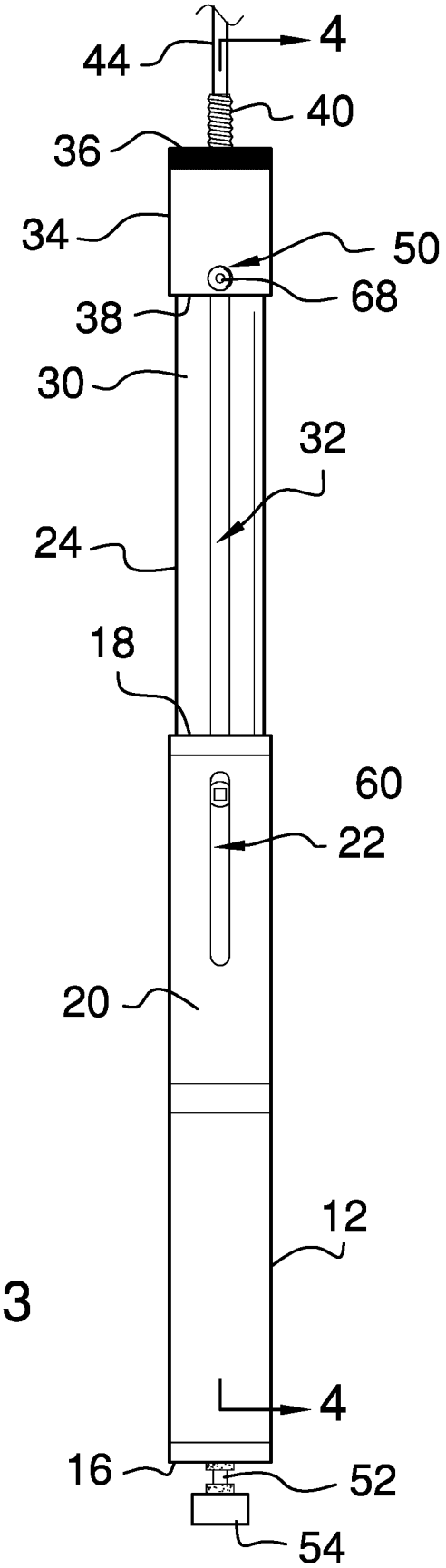
FIG. 3 is a right side view of an embodiment of the disclosure.
Figure 4:
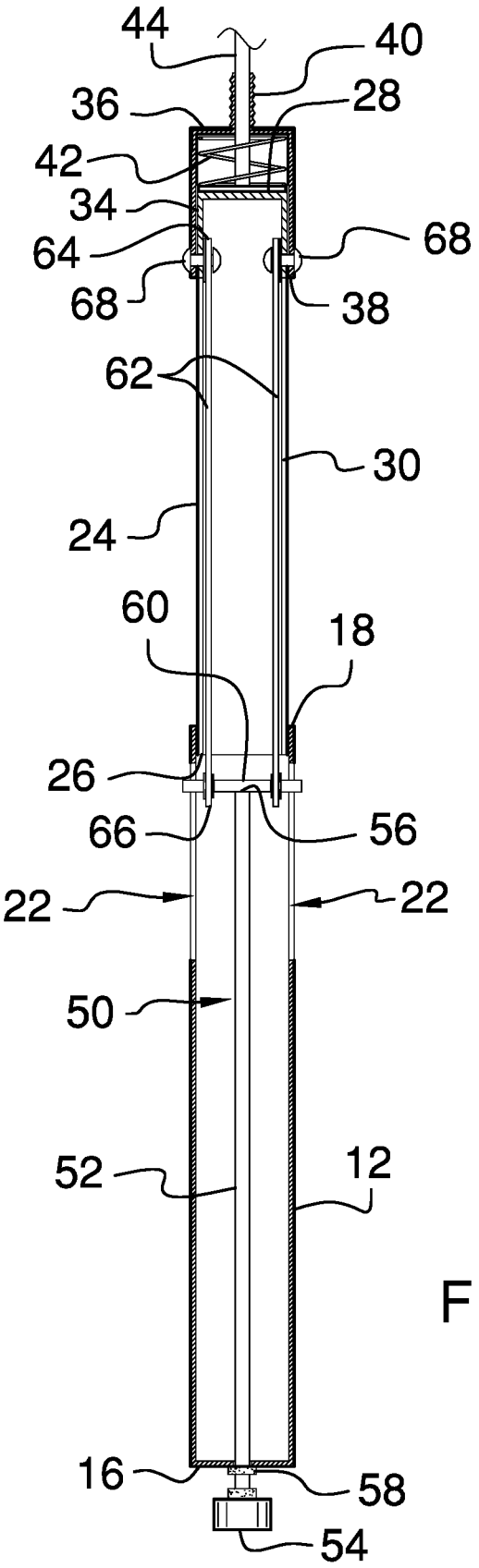
FIG. 4 is a cross sectional view taken along line 4-4 of FIG. 3 of an embodiment of the disclosure.
Figure 5:
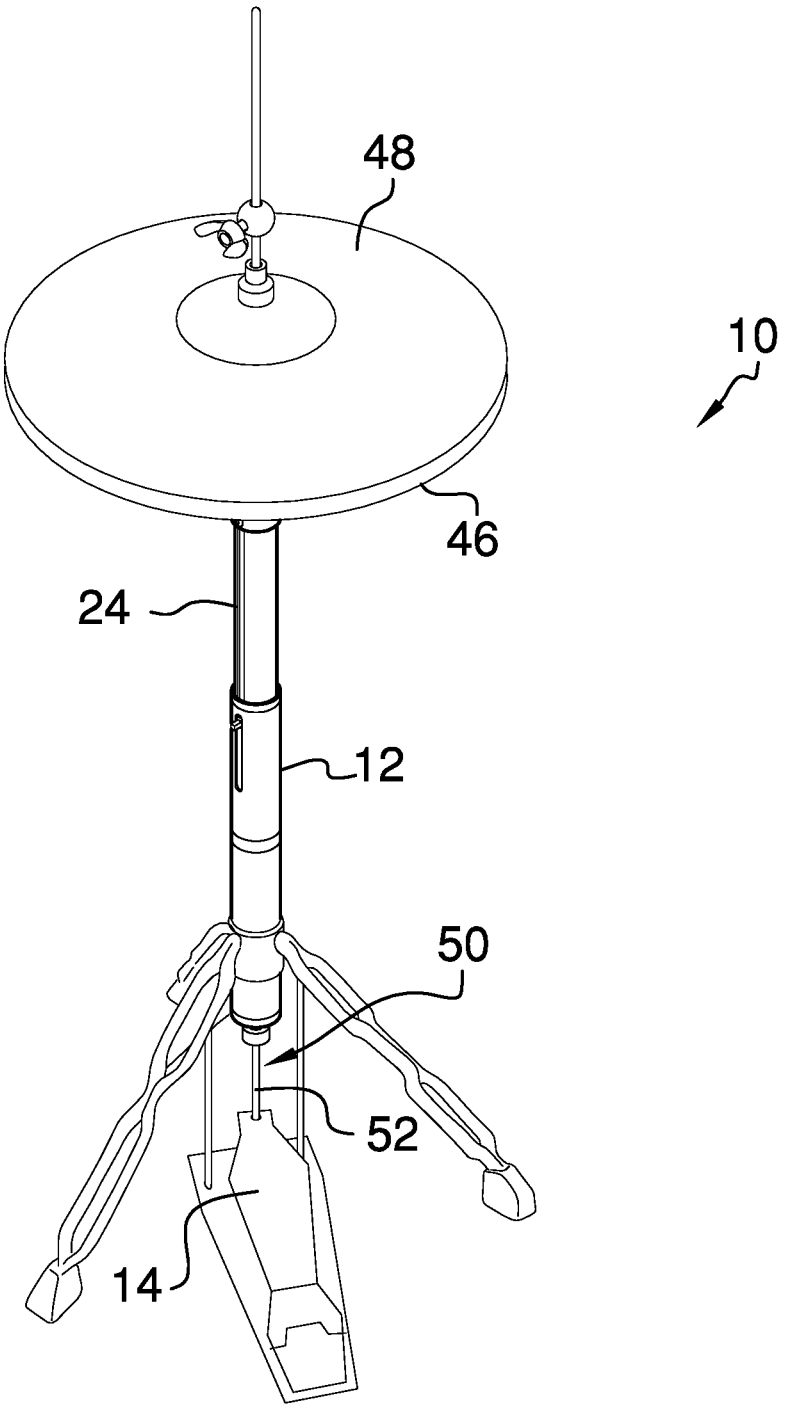
FIG. 5 is a perspective in-use view of an embodiment of the disclosure.

With reference now to the drawings, and in particular to FIGS. 1 through 5 thereof, a new high hat device embodying the principles and concepts of an embodiment of the disclosure and generally designated by the reference numeral 10 will be described.

As best illustrated in FIGS. 1 through 5, the high hat stand assembly 10 generally comprises a lower cylinder 12 that is positioned on a high hat pedal 14 of a drum kit having the lower cylinder 12 being vertically oriented. The lower cylinder 12 has a bottom end 16, a top end 18 and an outer wall 20 extending therebetween. The top end 18 is open and the lower cylinder 12 is hollow. The outer wall 20 has a pair of lower slots 22 each extending into an interior of the lower cylinder 12. Each of the lower slots 22 extends partially between the top end 18 and the bottom end 16, and each of the lower slots 22 is positioned closer to the top end 18 than the bottom end 16.

A middle cylinder 24 is coupled to and extends upwardly from the lower cylinder 12. The middle cylinder 24 has a lower end 26, an upper end 28 and an outside wall 30 extending therebetween. The lower end 26 is open, the middle cylinder 24 is hollow and the top end 18 of the lower cylinder 12 insertably receives the lower end 26 of the middle cylinder 24. The outside wall 30 has a pair of middle slots 32 each extending into an interior of the middle cylinder 24. Each of the middle slots 32 extends substantially between the upper end 28 and the lower end 26, and each of the middle slots 32 is aligned with a respective one of the lower slots 22.

A top cylinder 34 is slidably positioned on the middle cylinder 24 and the top cylinder 34 is slidable upwardly and downwardly on the middle cylinder 24. The top cylinder 34 has a topmost end 36 and a bottommost end 38; the bottommost end 38 is open and the bottommost end 38 insertably receives the upper end 28 the middle cylinder 24. Additionally, the topmost end 36 has a receiver 40 extending upwardly therefrom and the receiver 40 is threaded.

A biasing member 42 is positioned between the middle cylinder 24 and the top cylinder 34. The biasing member 42 biases the top cylinder 34 upwardly on the middle cylinder 24. A high hat rod 44 is coupled to and extends upwardly from the middle cylinder 24, and the high hat rod 44 extends through the top cylinder 34. Additionally, each of a bottom cymbal 46 and a top cymbal 48 of a high hat are positioned around the high hat rod 44. The bottom cymbal 46 is fixed to the top cylinder 34 and the top cymbal 48 is fixed to the high hat rod 44. Moreover, the top cylinder 34 is biased upwardly on the high hat rod 44 such that the bottom cymbal 46 is pressed against the top cymbal 48. Thus, the high hat is in a normally closed position as opposed to a high hat on a traditional high hat stand that would be in a normally open position. The high hat rod 44 extends upwardly through the receiver 40 on the topmost wall of the top cylinder 34 and the bottom cymbal 46 is fastenable to the receiver 40.

A lowering unit 50 is provided and the lowering unit 50 is movably integrated between the lower cylinder 12, the middle cylinder 24 and the top cylinder 34. The lowering unit 50 urges the top cylinder 34 downwardly on the middle cylinder 24 when the lowering unit 50 is actuated. In this way the bottom cymbal 46 is spaced from the top cymbal 48 to position the high hat in an open position.

The lowering unit 50 comprises a lower rod 52 that has a bottom end 54 and a top end 56. The lower rod 52 is positioned within the lower cylinder 12 and lower rod 52 extends through the bottom end 16 of the lower cylinder 12 such that the bottom end 54 of the lower rod 52 is exposed. The bottom end 54 of the lower rod 52 is operationally coupled to the high hat pedal 14 of a drum kit for lowering the lower rod 52 when the high hat pedal 14 is stepped on. A stop 58 is coupled around the lower rod 52, the stop 58 is spaced from the bottom end 16 of the lower rod 52 and the stop 58 abuts the bottom end 16 of the lower cylinder 12 when the lower rod 52 is lifted. In this way the lower rod 52 is inhibited from being fully retracted into the lower cylinder 12.

The lowering unit 50 includes a pin 60 that extends laterally through the lower rod 52 at a point adjacent to the top end 18 of the lower rod 52. Additionally, the pin 60 extends outwardly through each of the lower slots 22 in the outer wall 20 of the lower cylinder 12. The pin 60 travels upwardly and downwardly in the lower slots 22 when the lower rod 52 is urged upwardly and downwardly. The pin 60 may have a plurality of intersecting sides such that the pin 60 can be engaged by with a drum key. A pair of connecting arms 62 is included that each has an upper end 64 and a lower end 66. Each of the connecting arms 62 is positioned in the middle cylinder 24. The lower end 26 of each of the connecting arms 62 is pivotally coupled to the pin 60 such that the lower rod 52 raises and lowers the connecting arms 62.

A pair of engagements 68 is each pivotally coupled to the upper end 28 of a respective one of the connecting arms 62. Each of the engagements 68 extends through a respective one of the middle slots 32 in the middle cylinder 24 such that each of the engagements 68 travels upwardly and downwardly in the middle slots 32 when the lower rod 52 is urged upwardly and downwardly. Each of the engagements 68 engages the top cylinder 34 at a point located adjacent to the bottommost end 38 of the top cylinder 34. In this way each of the connecting arms 62 draws the top cylinder 34 downwardly when the lower rod 52 is urged downwardly. Additionally, the biasing member 42 biases the top cylinder 34 upwardly when the lower rod 52 moves upwardly.

In use, the bottom end 54 of the lower rod 52 is attached to the high hat pedal 14 on the drum kit. The bottom cymbal 46 of the high hat is slid downwardly on the high hat rod 44 and is attached to the top cylinder 34. The top cymbal 48 of the high hat is slid downwardly on the high hat rod 44 until the top cymbal 48 rests on the bottom cymbal 46. The top cymbal 48 is then retained on the high hat rod 44 with a cymbal clasp or the like. In this way the bottom cymbal 46 is drawn downwardly from the top cymbal 48, thusly opening the high hat, when the high hat pedal 14 is stepped on. The bottom cymbal 46 is lifted against the top cymbal 48 when the high hat pedal 14 is not stepped on. In this way the action of opening and closing a high hat cymbal is reversed with respect to traditional high hat stands.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A high hat stand assembly being configured to bias a high hat cymbal into a closed position and being urgeable into an open position, said assembly comprising:

a lower cylinder being positioned on a high hat pedal of a drum kit having said lower cylinder being vertically oriented;

a middle cylinder being coupled to and extending upwardly from said lower cylinder;

a top cylinder being slidably positioned on said middle cylinder, said top cylinder being slidable upwardly and downwardly on said middle cylinder;

a biasing member being positioned between said middle cylinder and said top cylinder, said biasing member biasing said top cylinder upwardly on said middle cylinder;

a high hat rod being coupled to and extending upwardly from said middle cylinder, said high hat rod extending through said top cylinder, said high hat rod having a bottom cymbal and a top cymbal of a high hat positioned therearound, said bottom cymbal being fixed to said top cylinder, said top cymbal being fixed to said high hat rod, said top cylinder being biased upwardly on said high hat rod such that said bottom cymbal is pressed against said top cymbal; and a lowering unit being movably integrated between said lower cylinder, said middle cylinder and said top cylinder, said lowering unit urging said top cylinder downwardly on said middle cylinder when said lowering unit is actuated such that said bottom cymbal is spaced from said top cymbal.

2. The assembly according to claim 1, wherein:

said lower cylinder has a bottom end, a top end and an outer wall extending therebetween, said top end being open, said lower cylinder being hollow; and said outer wall has a pair of lower slots each extending into an interior of said lower cylinder, each of said lower slots extending partially between said top end and said bottom end, each of said lower slots being positioned closer to said top end than said bottom end.

3. The assembly according to claim 2, wherein:

said middle cylinder has a lower end, an upper end and an outside wall extending therebetween, said lower end being open, said middle cylinder being hollow, said top end of said lower cylinder insertably receiving said lower end of said middle cylinder; and said outside wall has a pair of middle slots each extending into an interior of said middle cylinder, each of said middle slots extending substantially between said upper end and said lower end, each of said middle slots being aligned with a respective one of said lower slots.

4. The assembly according to claim 3, wherein said top cylinder has a topmost end and a bottommost end, said bottommost end being open, said bottommost end insertably receiving said upper end said middle cylinder, said topmost end having a receiver extending upwardly therefrom, said receiver being threaded.

5. The assembly according to claim 4, wherein said high hat rod extends upwardly through said receiver on said topmost wall of said top cylinder, said bottom cymbal being fastenable to said receiver.

6. The assembly according to claim 4, wherein said lowering unit comprises a lower rod having a bottom end and a top end, said lower rod being positioned within said lower cylinder, lower rod extending through said bottom end of said lower cylinder having said bottom end of said lower rod being exposed, said bottom end of said lower rod being operationally coupled to a high hat pedal of a drum kit for lowering said lower rod when the high hat pedal is stepped on.

7. The assembly according to claim 6, further comprising a stop being coupled around said lower rod, said stop being spaced from said bottom end of said lower rod, said stop abutting said bottom end of said lower cylinder when said lower rod is lifted.

8. The assembly according to claim 7, further comprising a pin extending laterally through said lower rod at a point adjacent to said top end of said lower rod, said pin extending outwardly through each of said lower slots in said outer wall of said lower cylinder, said pin traveling upwardly and downwardly in said lower slots when said lower rod is urged upwardly and downwardly.

9. The assembly according to claim 8, further comprising a pair of connecting arms, each of said connecting arms having an upper end and a lower end, each of said connecting arms being positioned in said middle cylinder, said lower end of each of said connecting arms being pivotally coupled to said pin such that said lower rod raises and lowers said connecting arms.

10. The assembly according to claim 9, further comprising a pair of engagements, each of said engagements being pivotally coupled to said upper end of a respective one of said connecting arms, each of said engagements extending through a respective one of said middle slots in said middle cylinder such that each of said engagements travels upwardly and downwardly in said middle slots when said lower rod is urged upwardly and downwardly.

11. The assembly according to claim 10, wherein each of said engagements engages said top cylinder at a point located adjacent to said bottommost end of said top cylinder, each of said connecting arms drawing said top cylinder downwardly when said lower rod is urged downwardly, said biasing member biasing said top cylinder upwardly when said lower rod moves upwardly.

12. A high hat stand assembly being configured to bias a high hat cymbal into a closed position and being urgeable into an open position, said assembly comprising:

a lower cylinder being positioned on a high hat pedal of a drum kit having said lower cylinder being vertically oriented, said lower cylinder having a bottom end, a top end and an outer wall extending therebetween, said top end being open, said lower cylinder being hollow, said outer wall having a pair of lower slots each extending into an interior of said lower cylinder, each of said lower slots extending partially between said top end and said bottom end, each of said lower slots being positioned closer to said top end than said bottom end;

a middle cylinder being coupled to and extending upwardly from said lower cylinder, said middle cylinder having a lower end, an upper end and an outside wall extending therebetween, said lower end being open, said middle cylinder being hollow, said top end of said lower cylinder insertably receiving said lower end of said middle cylinder, said outside wall having a pair of middle slots each extending into an interior of said middle cylinder, each of said middle slots extending substantially between said upper end and said lower end, each of said middle slots being aligned with a respective one of said lower slots;

a top cylinder being slidably positioned on said middle cylinder, said top cylinder being slidable upwardly and downwardly on said middle cylinder, said top cylinder having a topmost end and a bottommost end, said bottommost end being open, said bottommost end insertably receiving said upper end said middle cylinder, said topmost end having a receiver extending upwardly therefrom, said receiver being threaded;

a biasing member being positioned between said middle cylinder and said top cylinder, said biasing member biasing said top cylinder upwardly on said middle cylinder;

a high hat rod being coupled to and extending upwardly from said middle cylinder, said high hat rod extending through said top cylinder, said high hat rod having a bottom cymbal and a top cymbal of a high hat positioned therearound, said bottom cymbal being fixed to said top cylinder, said top cymbal being fixed to said high hat rod, said top cylinder being biased upwardly on said high hat rod such that said bottom cymbal is pressed against said top cymbal, said high hat rod extending upwardly through said receiver on said topmost wall of said top cylinder, said bottom cymbal being fastenable to said receiver; and a lowering unit being movably integrated between said lower cylinder, said middle cylinder and said top cylinder, said lowering unit urging said top cylinder downwardly on said middle cylinder when said lowering unit is actuated such that said bottom cymbal is spaced from said top cymbal, said lowering unit comprising:

a lower rod having a bottom end and a top end, said lower rod being positioned within said lower cylinder, lower rod extending through said bottom end of said lower cylinder having said bottom end of said lower rod being exposed, said bottom end of said lower rod being operationally coupled to a high hat pedal of a drum kit for lowering said lower rod when the high hat pedal is stepped on;

a stop being coupled around said lower rod, said stop being spaced from said bottom end of said lower rod, said stop abutting said bottom end of said lower cylinder when said lower rod is lifted;

a pin extending laterally through said lower rod at a point adjacent to said top end of said lower rod, said pin extending outwardly through each of said lower slots in said outer wall of said lower cylinder, said pin traveling upwardly and downwardly in said lower slots when said lower rod is urged upwardly and downwardly;

a pair of connecting arms, each of said connecting arms having an upper end and a lower end, each of said connecting arms being positioned in said middle cylinder, said lower end of each of said connecting arms being pivotally coupled to said pin such that said lower rod raises and lowers said connecting arms; and a pair of engagements, each of said engagements being pivotally coupled to said upper end of a respective one of said connecting arms, each of said engagements extending through a respective one of said middle slots in said middle cylinder such that each of said engagements travels upwardly and downwardly in said middle slots when said lower rod is urged upwardly and downwardly, each of said engagements engaging said top cylinder at a point located adjacent to said bottommost end of said top cylinder, each of said connecting arms drawing said top cylinder downwardly when said lower rod is urged downwardly, said biasing member biasing said top cylinder upwardly when said lower rod moves upwardly.

* * * * *